US005231732A

United States Patent [19]

Knoop et al.

[11] Patent Number: 5,231,732

[45] Date of Patent: Aug. 3, 1993

[54] SIDE DOOR HINGE

[75] Inventors: Robert D. Knoop, Beatrice, Nebr.; Ronald G. Lancaster, Springfield, Mo.; Kenneth L. Vogt, Plymouth, Nebr.

[73] Assignee: Custom Metalcraft Inc., Springfield, Mo.

[21] Appl. No.: 650,014

[22] Filed: Feb. 4, 1991

[51] Int. Cl.[5] ..... E05D 3/02

[52] U.S. Cl. ..... 16/267; 16/381; 16/254; 220/334

[58] Field of Search ..... 16/254, 260, 262, 263, 16/267, 356, 374, 376, 377, 381; 220/334, 342, 337, 334

[56] References Cited

U.S. PATENT DOCUMENTS

| | | | |
|---|---|---|---|
| 44,076 | 9/1864 | Colburn | 16/377 |
| 338,832 | 12/1906 | Woodbury | 16/377 |
| 1,079,536 | 11/1913 | Baum | 16/356 |
| 1,245,376 | 11/1917 | Otte . | |
| 1,263,203 | 4/1918 | Burnett . | |
| 1,282,233 | 10/1918 | Kehoe . | |
| 1,380,587 | 6/1921 | Phillips . | |
| 1,685,002 | 9/1928 | Matranga . | |
| 1,715,538 | 6/1929 | Dean et al. . | |
| 2,341,537 | 2/1944 | Froelich | 16/267 |
| 2,652,587 | 9/1953 | Petersen . | |
| 3,633,244 | 1/1972 | Grossman . | |
| 3,651,537 | 3/1972 | Nichols | 16/267 |
| 3,835,585 | 9/1974 | Anderson et al. | 16/254 |
| 4,033,476 | 7/1977 | Greenquist | 16/267 |
| 4,151,928 | 5/1979 | Fagliano et al. | 220/343 |
| 4,223,219 | 9/1980 | Wassenaar . | |
| 4,873,745 | 10/1989 | Ramsauer | 16/261 |
| 4,979,264 | 12/1990 | Ramsauer | 16/267 |
| 4,984,333 | 1/1991 | Karpisek | 16/363 |

OTHER PUBLICATIONS

International Application Published under PCT No. WO 87/07321, pub. Dec. 3, 1987; inventor: Chapel.

*Primary Examiner*—Lowell A. Larson

*Attorney, Agent, or Firm*—Nies, Kurz, Bergert & Tamburro

[57] ABSTRACT

An improved hinge assembly for use on containers having a door on at least one side wall is disclosed. The features of the invention include the following: removable hinge rod for complete cleaning with rod held in place by a removable end mechanical retaining member; full length support for the door; end cap and hinge can be completely welded to pass sanitary construction specifications; enables use of aluminum or stainless steel rods; permits use of stainless steel hinge rod on aluminum containers; hinge rod can turn or rotate in end support areas or caps thereby avoiding binding or bending when installing door; and a hinge assembly area is easily cleaned; invention employs a continuous horizontal hinge rod which opens the hinge area for cleaning and continuous hinge support.

5 Claims, 3 Drawing Sheets

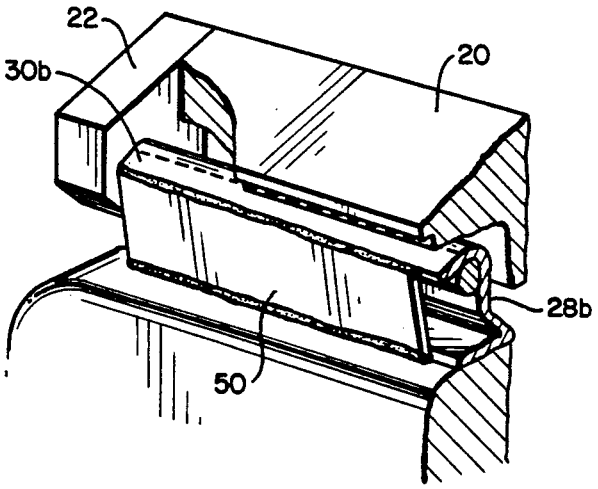
FIG. 6
FIG. 8
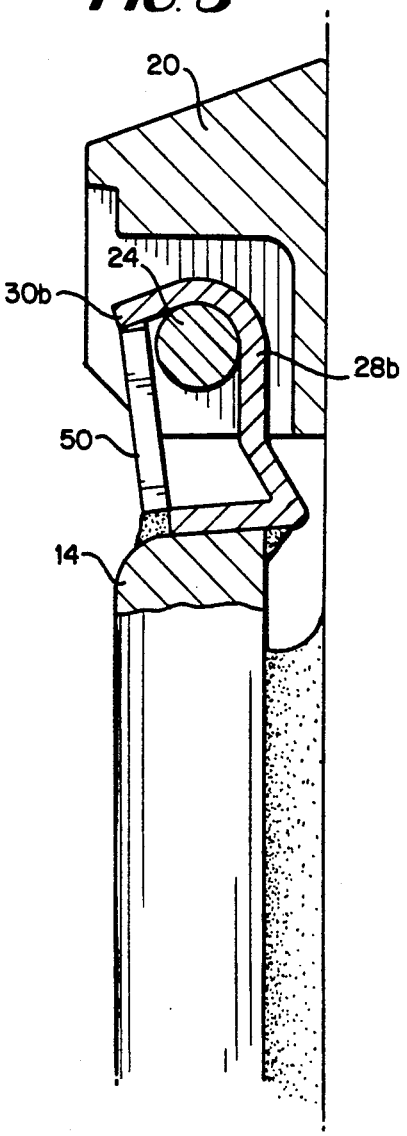
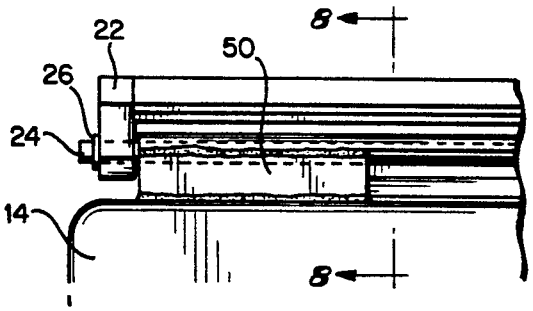
FIG. 7

SIDE DOOR HINGE

BACKGROUND AND SUMMARY OF THE INVENTION

The present invention relates to a door hinge for use on side door containers. More particularly, the present invention relates to a door hinge having features which allow the hinge to support a side door on a container to assist in opening and closing of the side door while permitting easy cleaning of the area adjacent the hinge.

Previous hinge constructions are described in the following U.S. Pat. Nos. 1,245,376 to Otte; 1,263,203 to Burnett; 1,282,233 to Kehoe; 1,380,587 to Phillips; 1,685,002 to Matranga; 1,715,538 to Dean et al.; 2,652,587 to Petersen; 3,633,244 to Grossman; 3,651,537 to Nichols; 4,033,476 to Greenquist; and 4,223,421 to Wassenaar.

By the present invention, there is provided an improved hinge assembly for use on containers on which a door is located along one side wall of the container.

The features of the side door hinge of the present invention include the following: removable hinge rod for complete cleaning with rod held in place by a removable end mechanical retaining member; full length support for the door; end cap and hinge can be completely welded to pass sanitary construction specifications; enables use of aluminum or stainless steel rods; permits use of stainless steel hinge rod on aluminum containers; hinge rod can turn or rotate in end support areas or caps thereby avoiding binding or bending when installing door; hinge assembly area is easily cleaned; and an alternate design for the door hinge may employ "half moon" or "full" sections as required to make the door permanently mounted when using a removable end snap ring. The present invention employs a continuous horizontal hinge rod which opens the hinge area up for cleaning and continuous hinge support.

BRIEF DESCRIPTION OF THE DRAWINGS

FIG. 6 is a perspective view in partial cross section of a second alternative embodiment of the present invention.

FIG. 7 is a partial front elevation of the embodiment of FIG. 6.

FIG. 8 is a cross-sectional view taken along line 8—8 of FIG. 7.

DESCRIPTION OF THE PREFERRED EMBODIMENTS

Figure 1:
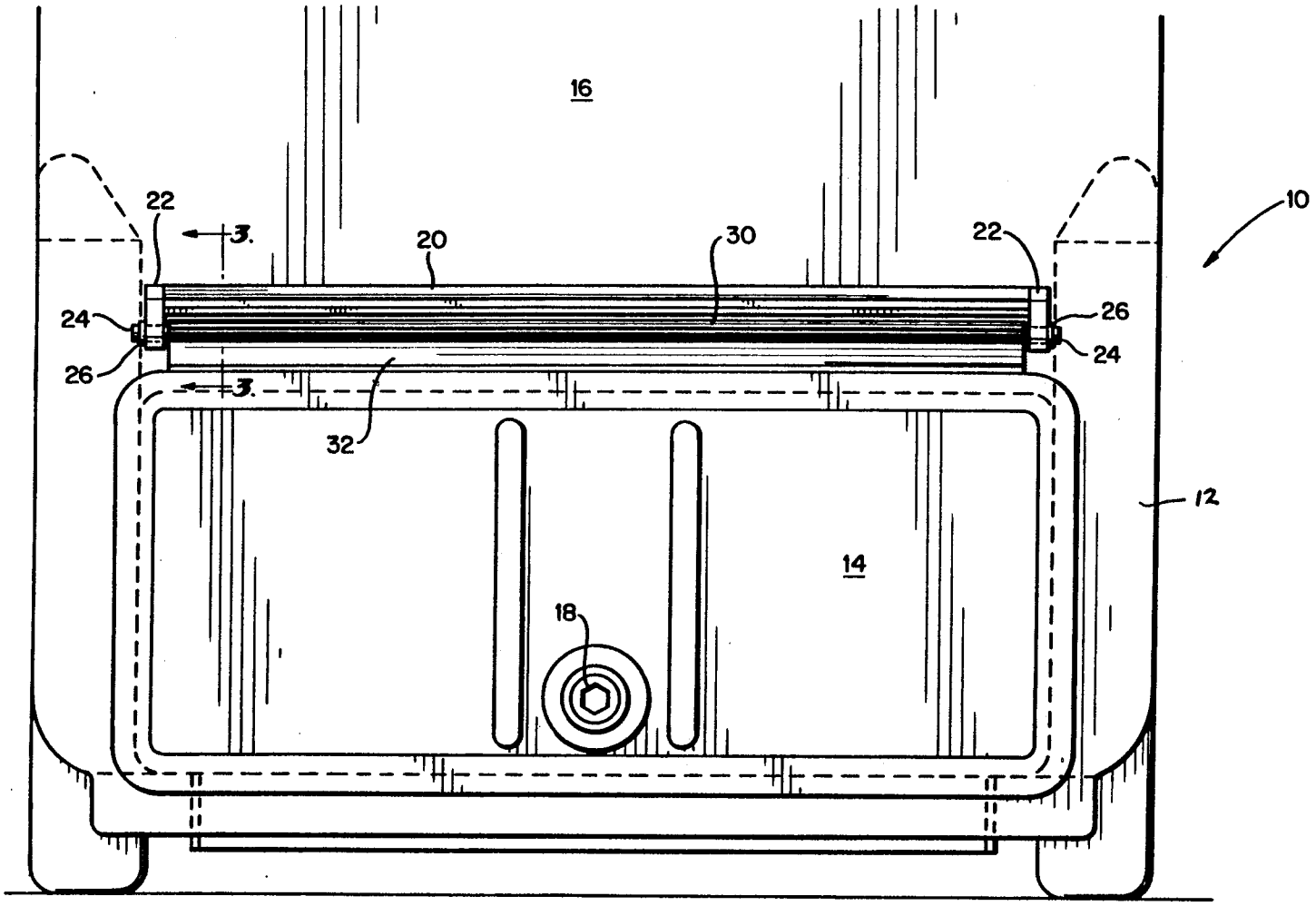
FIG. 1 is a side elevation of a container having a side door hinge in accordance with the present invention.
Figure 2:
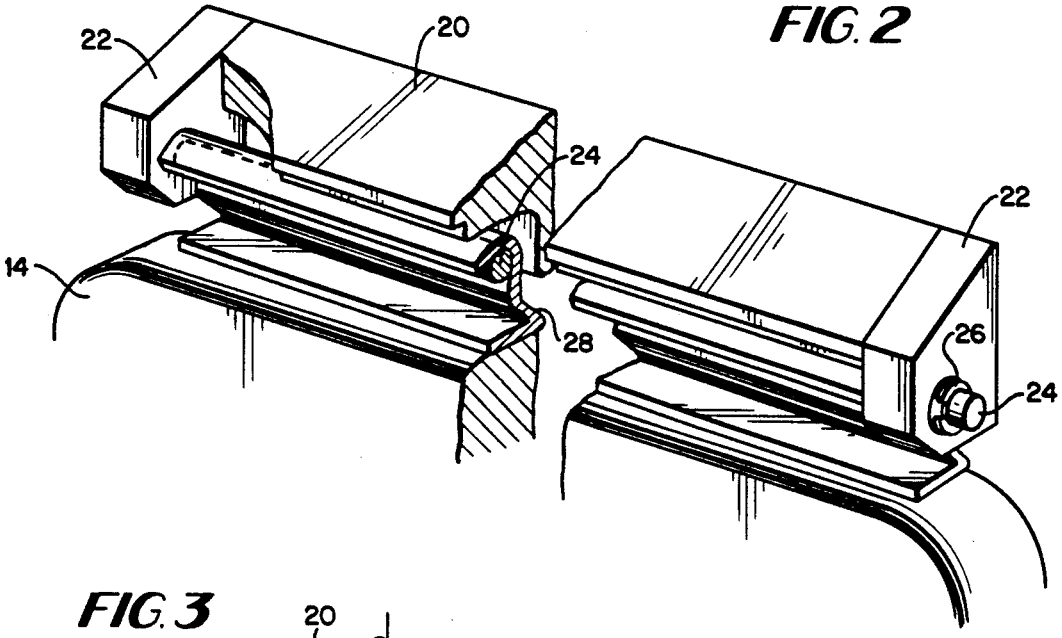
FIG. 2 is a perspective view in partial cross section of the container with side door hinge of FIG. 1.
Figure 3:
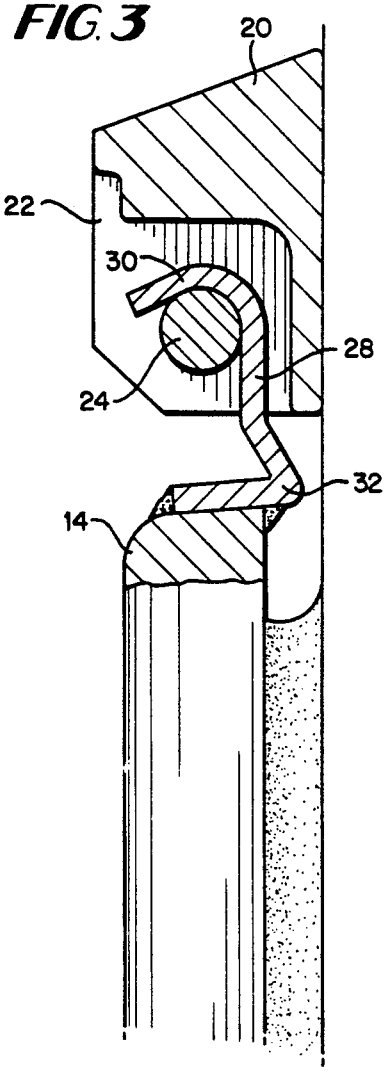
FIG. 3 is a cross sectional view of the hinge construction taken along line 3—3 of FIG. 1.

In the embodiment of the present invention as shown in FIGS. 1 through 3, there is provided a side door hinge assembly 10 for a container 12. The hinge 10 is employed to mount a side door 14 along a vertical side wall 16 of the container 12. The door 14 is provided with a conventional latch assembly 18 for releasably maintaining the door in a closed position.

The hinge assembly 10 includes a hinge support member 20 which is welded or otherwise secured to the side wall 16. This member 20 may be provided in the form of an extruded or fabricated component. An end cap member 22 is mounted at each end of the support member 20. Each end cap member 22 has an opening therein for receiving one end of a hinge rod 24 which is rotatably mounted in each of the end caps 22 and retained therein by a suitable retaining mechanism 26 such as a cotter pin, snap ring, clip or the like, positioned outwardly of the end caps 22. Thus the hinge rod 24 extends the length of the hinge assembly 10.

As shown in FIGS. 2 and 3, a hinge member 28 is positioned interiorly of the end caps 22 and pivotably mounted on the hinge rod 24. The hinge member 28 is formed with an upper portion 30 of a curved shape so as to have a portion thereof concentric with the rod 24. The outer end of the upper portion 30 extends outwardly from the rod 24. The lower end portion 32 of the hinge 28 is formed in a V-shape to provide additional strength, with the lower arm or side thereof secured to the upper end of the door 14. The upper arm of the V-shaped portion 32 is positioned at an angle of about 60 degrees to the horizontal. The notch of the V-shaped portion 32 projects inwardly beyond the door 14, as shown in FIG. 3. In this embodiment, the hinge 28 may be removed from the rod 24 and the door 14 thus removed from the assembly 10 by raising the door 14 and thus rotating the hinge 28 in a clockwise direction about the rod 24 until the door 14 is raised sufficiently to allow the curved upper end 30 of the hinge 28 to drop free of the hinge rod 24. Thus the hinge 28 is easily removed for cleaning and maintenance.

Figure 4:
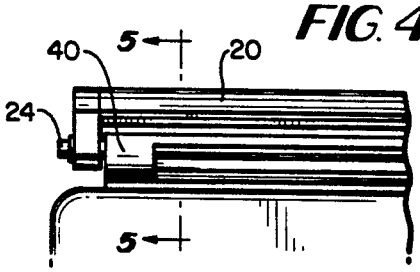
FIG. 4 is a partial front elevation of a first alternative embodiment of the side door hinge of the present invention.
Figure 5:
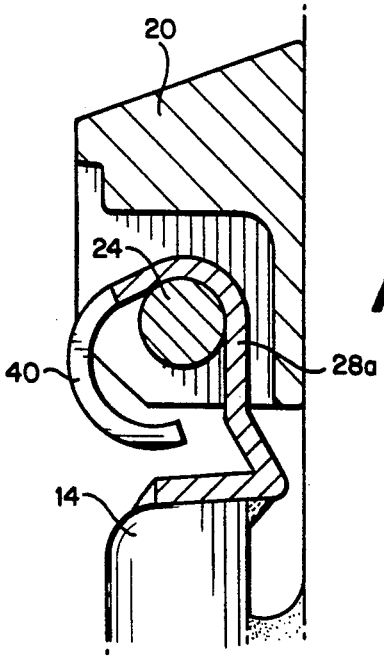
FIG. 5 is a cross-sectional view taken along line 5—5 of FIG. 4.

In the embodiment as shown in FIGS. 4 and 5, the hinge member **28*a* is provided with a semi-circular or half moon extension 40 on the ends thereof, thus preventing the door 14 from being removed unless the hinge rod 24** is itself removed.

The embodiment of FIGS. 6 through 8 includes a hinge member **28*b* having a flat plate member 50 secured by means such as welding to each end of the hinge member 28*b*. In one embodiment, the plate member 50** is formed of 12 gauge stainless steel having a vertical width of $1\frac{1}{8}$ inches and a length of 6 inches.

The construction as shown in FIGS. 6 through 8 effectively prevents removal of the door 14 without first removing the hinge rod 24.

The materials employed for the components of the various embodiments described above may include the following: the hinge rod 24 and snap ring 26 are preferably of stainless steel; the door 14, the hinge support member 20 and the end cap members 22 may be constructed of steel, stainless steel or aluminum. Such materials are particularly desirable for meeting the requirements of sanitary construction specifications.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. A side door hinge assembly with horizontally spaced ends for use in opening and closing of a side door mounted over a discharge opening in the side wall of a container or bin, comprising:

a hinge rod having a longitudinal axis and mounted on said side wall in a generally horizontal position; and a hinge member mounted on said door and extending substantially the length of said hinge rod for retaining said door on said hinge rod, said hinge member having a curved upper portion which extends around the upper surface of said hinge rod and a lower portion for attachment to said door, wherein the curved upper portion of said hinge member includes, with respect to the closed door position, a vertically extending tangential portion joined to a portion which is concentric with said hinge rod for approximately $\frac{1}{4}$ of the circumference of said hinge rod, and with the outer end of said curved upper portion adjacent said concentric portion extending outwardly from the hinge rod at an acute angle relative to a vertical plane through the longitudinal axis of said hinge rod.

2. The side door hinge of claim 1 further including a pair of end caps mounted on said side wall for receiving each end of said hinge rod.

3. The side door hinge of claim 2 further including a hinge support member mounted on said side wall, and wherein one of said end caps is mounted at each end of said support member.

4. The side door hinge of claim 3 further including means for retaining said hinge rod in said end caps.

5. The side door hinge of claim 2 wherein said hinge rod is rotatably mounted in said end caps.

* * * * *